US009863045B2

(12) United States Patent
Dhananjeyan et al.

(10) Patent No.: US 9,863,045 B2
(45) Date of Patent: Jan. 9, 2018

(54) ELECTROCHEMICAL PROCESS FOR THE PREPARATION OF LEAD FOAM

(71) Applicant: COUNCIL OF SCIENTIFIC & INDUSTRIAL RESEARCH, New Delhi (IN)

(72) Inventors: Manikka Venkatachalapthi Thulasiram Dhananjeyan, Karaikudi (IN); Kopula Kesavan Jagadesh, Karaikudi (IN); GiriNagasamy Kuppusamy Ramesh Babu, Karaikudi (IN); Somasundaram Ambalavanan, Karaikudi (IN); Ramachandran Sekar, Karaikudi (IN)

(73) Assignee: COUNCIL OF SCIENTIFIC & INDUSTRIAL RESEARCH, New Delhi (IN)

( * ) Notice: Subject to any disclaimer, the term of this patent is extended or adjusted under 35 U.S.C. 154(b) by 134 days.

(21) Appl. No.: 15/080,512

(22) Filed: Mar. 24, 2016

(65) Prior Publication Data

US 2016/0281250 A1 Sep. 29, 2016

(30) Foreign Application Priority Data

Mar. 24, 2015 (IN) ..... 803/DEL/2015

(51) Int. Cl.
*C23F 1/18* (2006.01)
*C23C 18/40* (2006.01)
(Continued)

(52) U.S. Cl.
CPC ..... *C23F 1/18* (2013.01); *C23C 18/1648* (2013.01); *C23C 18/1653* (2013.01);
(Continued)

(58) Field of Classification Search
CPC ..... C23F 1/18; C23C 18/408; C23C 18/1696; C23C 18/1653; C23C 18/1648; C23C 18/30; C25D 1/00; C25D 1/06; C25D 3/34
See application file for complete search history.

(56) References Cited

U.S. PATENT DOCUMENTS 2,917,384 A 12/1959 Grandey et al.
3,790,365 A 2/1974 Niebyski et al.
(Continued)

OTHER PUBLICATIONS

Keju Ji, Chen Xu, Huihui Zhao, Zhendong Dai, Electrodeposited lead-foam grids on copper-foam substrates as positive current collectors for lead-acid batteries, in Journal of Power Sources, vol. 248, 2014, pp. 307-316, ISSN 0378-7753, https://doi.org/10.1016/j.jpowsour.2013.09.112. (Year: 2014).*
(Continued)

*Primary Examiner* — Louis J Rufo
(74) *Attorney, Agent, or Firm* — Maschoff Brennan

(57) ABSTRACT

The present invention provides a methodology of making lead foam by an electrochemical process in which non-conducting poly urethane foam was metalized using palladium chloride solution which was then coated with lead using the plating bath containing fluoboric acid, Lead as fluoborate solutions, boric acid and urea. The process was operated at a current density ranging from 0.5 A/dm$^2$ to 5 A/dm$^2$, bath pH from 0.5 to 2.0, at temperature range from 30° C. to 50° C., followed with suitable post plating treatments. The surface morphology of the lead foam thus obtained was studied. The composition and purity of the lead foam was characterized with XRD. The porosity obtained depends upon the rate of deposition. The average value of the porosity realized in the range 86-79% with respect to time of deposition 2-6 h and the corresponding thickness of 45 to 60 micron.

8 Claims, 4 Drawing Sheets

(51) Int. Cl.

| | |
|---|---|
| ***C23C 18/16*** | (2006.01) |
| ***C25D 1/00*** | (2006.01) |
| ***C25D 1/08*** | (2006.01) |
| ***C25D 3/34*** | (2006.01) |
| ***C23C 18/30*** | (2006.01) |

(52) U.S. Cl.
CPC ..... *C23C 18/1696* (2013.01); *C23C 18/405* (2013.01); *C25D 1/00* (2013.01); *C25D 1/08* (2013.01); *C25D 3/34* (2013.01); *C23C 18/30* (2013.01)

(56) References Cited

U.S. PATENT DOCUMENTS

| | | | | |
|---|---|---|---|---|
| 3,816,952 | A | 6/1974 | Niebyski et al. | |
| 4,076,888 | A | 2/1978 | Perugini et al. | |
| 4,206,031 | A | 6/1980 | King | |
| 4,957,543 | A | 9/1990 | Babjaktal | |
| 5,622,542 | A | 4/1997 | Thomas et al. | |
| 6,464,933 | B1 | 10/2002 | Popoola et al. | |
| 6,659,162 | B2 | 12/2003 | Formmeyer et al. | |
| 6,979,513 | B2 | 12/2005 | Kelly et al. | |
| 7,402,277 | B2 | 7/2008 | Ayer et al. | |
| 7,621,314 | B2 | 11/2009 | Schrorers et al. | |
| 2017/0167041 | A1* | 6/2017 | Poss | C25D 7/00 |

OTHER PUBLICATIONS

Qu, When-Chao; Tian, Qing-hua; Guo, Xue-yi, "Study on Preparing Technique of Foam Lead", Metal Materials and Metallurgy Engineering, vol. 39, No. 4, Aug. 2011. pp. 8-12.*

Wen-chao Qu, et al., "Study on Preparing Technique of Foam Lead," School of Metallurgical Science and Engineering, The Metal Material and Metallurgy Engineering, 2011-04.

* cited by examiner

ELECTROCHEMICAL PROCESS FOR THE PREPARATION OF LEAD FOAM

FIELD OF THE INVENTION

The present invention relates to an electrochemical process for the preparation of lead foam.

BACKGROUND OF THE INVENTION

In the present scenario, lead foam is prepared by coating lead over the copper foam, which has good conductivity, and a uniform three-dimensional reticulate structure. However, the stability of foam in its application in the lead-acid battery system is affected due to the reaction of electrolyte (sulphuric acid) with the copper on account of pores. The present invention forefend the contact problem and interaction of electrolyte etc., which gives good performance because of the method of preparation of lead foam excluded the copper. Till date, the total scenario of metallic foam and the available technology for the preparation of metallic foam are:

| Patent No. | Reg. date. | Inventor | Field of search |
|---|---|---|---|
| U.S. Pat. No. 5,622,542 | Apr. 22, 1997 | Thomas et al., | 75/415 428/593 |
| U.S. Pat. No. 6,659,162 B2 | Dec. 9, 2003 | Formmeyer et al., | 164/79, 428 |
| U.S. Pat. No. 3,816,952 | Jun. 18, 1974 | Niebyski et al., | 75/20, 138 |
| U.S. Pat. No. 4,076,888 | Feb. 28, 1978 | Perugini et al., | 428/311, 428/308 |
| U.S. Pat. No. 6,979,513 B2 | Dec. 27, 2005 | Kelly et al., | 429/121, 429/236 |
| U.S. Pat. No. 6,464,933 B1 | Oct. 15, 2002 | Popoola et al., | 419/2, 427/247, 455 |
| U.S. Pat. No. 3,790,365 | Feb. 5, 1974 | Niebyski et al., | 75/20F, 20R, 86 |
| U.S. Pat. No. 4,206,031 | Jun. 3, 1980 | King | 204/149, 210/49 |
| U.S. Pat. No. 4,957,543 | Sep. 18, 1990 | Babjaketal. | 70/20F, 419/2, 428/614 |
| U.S. Pat. No. 7,402,277 B2 | Jul. 22, 2008 | Ayer et al., | 419/2, 8, 9 427/191 |
| U.S. Pat. No. 7,621,314 B2 | Nov. 24, 2009 | Schrorers et al., | 164/79, 148/403 |
| U.S. Pat. No. 2,917,384 | Dec. 15, 1959 | Grandey et al., | 264/44, 419/37 |

References may be made to U.S. Pat. No. 5,622,542 Thomas et al., that identifies the process for producing metal foam from a composite capable of forming foam by heating the matrix above its liquid temperature and then foamed by injecting gas in to the material to form a particle stabilized metal foam. Foam is prepared by liquid—gas phase technique.

The U.S. Pat. No. 6,659,162 B2 by Frommeyer et al., discloses the processes for producing large area integral metal foam by adding a blowing agent to a metal melt is described. This method follows continuous injection of blowing agent into a roll nip to form metal foam, and claims that the gas and solid released at room temperature and is fully foamed to form large area integral metal foam. Foam is prepared by adding blowing agent to the molten metal to form foam.

In the U.S. Pat. No. 3,816,952 by Niebyski et al., blowing agent materials such as titanium hydride, hafnium, zirconium, metal hydride etc., were mixed with the molten metal in order to increase the viscosity, gases such as air, oxygen, nitrogen, argon etc., were injected in to the melt to prepare metal foam, in particular the aluminum foam. Foam is prepared by adding blowing agent to the molten metal.

The U.S. Pat. No. 4,076,888 by Perugini et al., discloses preparation of metal/metal ceramic foam (sponge). This process starts from a plastic sponge with three dimensional cellular structures and coating the metal or ceramic-metal composition by using techniques such as molten spray deposition, galvanic codeposition, and evaporation under vacuum or reactive sputtering for selected metals. In this patent foam is prepared by molten spray technique under vacuum technique. The patent claims the unaltered filiform morphology.

The U.S. Pat. No. 6,979,513 B2 by Kelley et al., used the carbon foam as grid and pasting chemically active material in the pores of carbon foam for making positive and negative plates to be used in lead-acid batteries. This method claims that the carbon foam is used as current collector which results poor adherence of active material to the substrate.

The U.S. Pat. No. 6,464,933 B1 by Popoola et al., describes the formation of metal foam by introducing metal powder supply along with foaming agent into a propellant gas which form gas/particle mixture stream. The mixture is then projected over a metallic substrate at sonic velocity. The coated substrate treated thermal excursion effective to active expansion of the foaming agent there by making metal foam. The technique uses thermal excursion using gas/particle mixture stream, which is a high temperature process.

The U.S. Pat. No. 3,790,365 by Niebylski et al., describes that by decomposing one or more blowing agents in a molten metal with blowing gas. This method uses expansion and cooling repeatedly with intermediate stirring and adding foaming agents to form metal foam. This method uses blowing agent with blowing gas in a molten bath for metal foam development.

The U.S. Pat. No. 4,206,031 by King et al., describes a methodology for preparation of metal foam using electrolytic action that exposed in the liquid metal results in metal foam. The unique claim by author is that the formation of thick, creamy foam on upper surface of liquid metal. The author also described the foam generating apparatus, which explains the apparatus having two electrodes exposed to incoming metal liquid got foamed by electrolytic action. The author uses thick, creamy foam formation on the upper surface of the molten metal.

The U.S. Pat. No. 4,957,543, Babjak et al., provide a methodology to make nickel foam, where an open cell foam structure is placed in a nickel carbonyl gas chamber. The chamber will be heated to a temperature where the gas decomposes to nickel will results in nickel foam. The method uses reducing the metal carbonyl to pure metal foam, which is a high temperature processing technique.

The U.S. Pat. No. 7,402,277 B2, Ayer et al., present a method of foaming metallic foam by using cold spray process, in that the mixture of metal particle and foaming agent are mixed together and spray coated on a substrate which to form unexpanded metallic layer. The obtained substrate is subjected to heat treatment above decomposition temperature there-by made expanded metal foam. The technique uses spray process on a substrate and using high temperature heat treatment process to obtain expanded metal foam The U.S. Pat. No. 7,621,314 B2, Schrorers et al., confirm the production of metallic foams from bulk-solidification of alloys. It describes the method of making the amorphous metallic foam and the apparatus which has heating and cooling zone along with gas injection design. The patent uses heating and cooling with gas injection to form metal foam The U.S. Pat. No. 2,917,384, Max Ferdinand Grandey et al., develop foams of nickel, chromium, aluminum, cobalt, iron, titanium, nichrome, stainless steel from its metal powders mixed with foamable resin such as silicone, isocyanate, polyester where condition desires. The mixture of metal and resins will be treated under reduced or inert atmosphere at the melting temperature to obtain corresponding metal foams. Powder metallurgy technique is used in preparing metal foam The Metal Material and Metallurgy Engineering, 2011, 04 by QuWen-chao et al., discloses regarding the preparation of lead foam is by electro-deposition method. The author uses polyurethane foam as substrate for developing lead foam. The stage one goes along with coating of copper on substrate using electroplating technique with current density of 3.0 A/dm$^2$, polar distance of 3.5 cm, and galvanized for about 35 min which is forming thick copper coating over the surface. This will as similar as copper foam and it was followed by the second step coating of lead plating with a current density of 3.0 A/dm$^2$, at temperature of 25° C. and galvanization time of 30-40 min. This results in the formation of lead over copper coating.

SUMMARY OF THE INVENTION

The present invention provides a process for preparation of lead foam. More specifically, the present invention provides an electrochemical process for the preparation of lead foam, wherein the lead foam is substantially free of other metallic impurity and polymer foam.

In one specific embodiment, the present invention provides a process for preparation of lead foam, wherein the process comprises the steps:

(i) providing a polymer foam and coating a thin conductive layer over the surface of polymer foam, (ii) coating copper over the conductive polymer foam as obtained in step (i) by electroless process to obtain copper coated polymer foam, (iii) depositing lead over the copper coated polymer foam as obtained in step (ii) by electroplating process to obtain lead plated copper coated polymer foam, (iv) removing the polymer foam and copper from the lead plated copper coated polymer foam as obtained in step (iii) by dipping it in organic solvent followed by sulphuric acid treatment to obtain lead foam.

In a further embodiment, the process further comprises the step of treating the lead foam at 180 to 210° C. for 1 to 3 hrs in reduced atmosphere to remove oxygen present in the lead foam.

In a further embodiment, the present invention provides an electrochemical process for preparation of lead foam, wherein the process comprises the steps of:

(i) dipping a non-conducting polymer foam in palladium chloride solution having concentration 1:100 ratio by electroless process to obtain a thin conductive layer over the surface of polymer foam, (ii) coating copper over a thin conductive layer over the surface of polymer foam as obtained in step (i) by electroless process using copper sulphate, paraformaldehyde, EDTA and gelatin at room temperature for 2 to 5 min to obtain copper coated polymer foam, (iii) depositing lead over copper coated polymer foam as obtained in step (ii) by electroplating process wherein the lead plating bath contains 100-200 g/l fluoboric acid, 150-250 g/l Lead as fluoborate solutions, 20-30 g/l boric acid and 2-4 g/l urea at a current density in the range 0.5 to 5.0 A/dm$^2$, bath pH ranging from 0.5 to 2 at temperature ranging from 30 to 50° C. for 2 to 6 hrs to obtain lead plated copper coated polymer foam, (iv) removing polymer foam and copper from lead plated copper coated polymer foam as obtained in step (iii) by dipping it in organic solvent for time ranging from 2 to 5 min followed by sulphuric acid treatment for 1 to 5 min to obtain lead foam, (v) removing oxygen present in the lead foam by heat treating the product as obtained in step (iv) at 180 to 210° C. for 1 to 3 hrs in reduced atmosphere.

In a specific embodiment, the polymer foam used in the electrochemical process for the preparation of lead foam is polyurethane foam of porosity in the range of 80% to 90%. The copper coating by electroless process is done by using concentration of 30 g/L copper sulphate, 10 g/L paraformaldehyde, 15 g/L EDTA and 0.5 g/L gelatin. In a preferred embodiment, the thickness of the lead coating obtained is 45-180 μm. In a further preferred embodiment, the organic solvents used in the electrochemical process for the preparation of lead foam is preferably selected from acetone, N-methyl pyrrolidone and dimethyl formamide in the ratio 1:5:3 respectively. In yet another preferred embodiment, the reduced atmosphere generated is preferably selected from hydrogen:argon in the ratio 10:90 gas mixture.

BRIEF DESCRIPTION OF THE DRAWINGS

Embodiments of the present invention are illustrated in FIGS. 1 to 4 of the drawings accompanying this specification.

DETAILED DESCRIPTION OF THE INVENTION

The novelty of the present invention is to develop pure lead foam by depositing 1-2 micron thickness of copper on polyeurethene foam by an electroless process and subsequent coating of lead over the foam by electroplating technique. After depositing the lead both polyeurethene and copper were removed by dipping in the organic solvent and sulphuric acid respectively. In this way pure lead foam is obtained without any trace of copper confirmed by XRD.

The phase composition of the lead foam is determined with Bruker X-ray diffractometer (Netherlands) between (2θ) values of 20° and 100° at a scan rate of 2° per min using Cu—$K_\alpha$(λ=1.5405 Å) radiation. The characteristic XRD peak values of lead foam obtained are as given in the following Table 1.

TABLE 1

| Pos. [°2Th.] | d-spacing [Å] | Rel. Int. [%] | Plane (hkl) |
|---|---|---|---|
| 31.7238 | 2.82065 | 100.00 | (111) |
| 36.7724 | 2.44416 | 82.61 | (200) |
| 52.6458 | 1.73858 | 57.17 | (220) |
| 62.5740 | 1.48450 | 88.91 | (311) |
| 65.6556 | 1.42209 | 27.83 | (222) |
| 85.8915 | 1.13156 | 32.83 | (331) |
| 88.6148 | 1.10369 | 32.39 | (420) |

The main object of the present invention is to develop a process for preparation of lead foam which obviates the drawback of the hitherto known prior art as detailed above, another object of the present invention is the use of electroplating technique in combination with electroless plating.

Yet another object of the invention is the use of polymer foam as base substrate to achieve the similar lead structure as of foam material.

The invention describes the removal of base skeleton of polymer after attaining lead reticulated filament structure (lead foam) by using organic liquids for etching out the base material and acid treatment to remove the inorganic residues available in lead foam. Also, the invention explains the method of removing oxygen from coated lead (lead foam) to get high conductivity.

Figure 1:
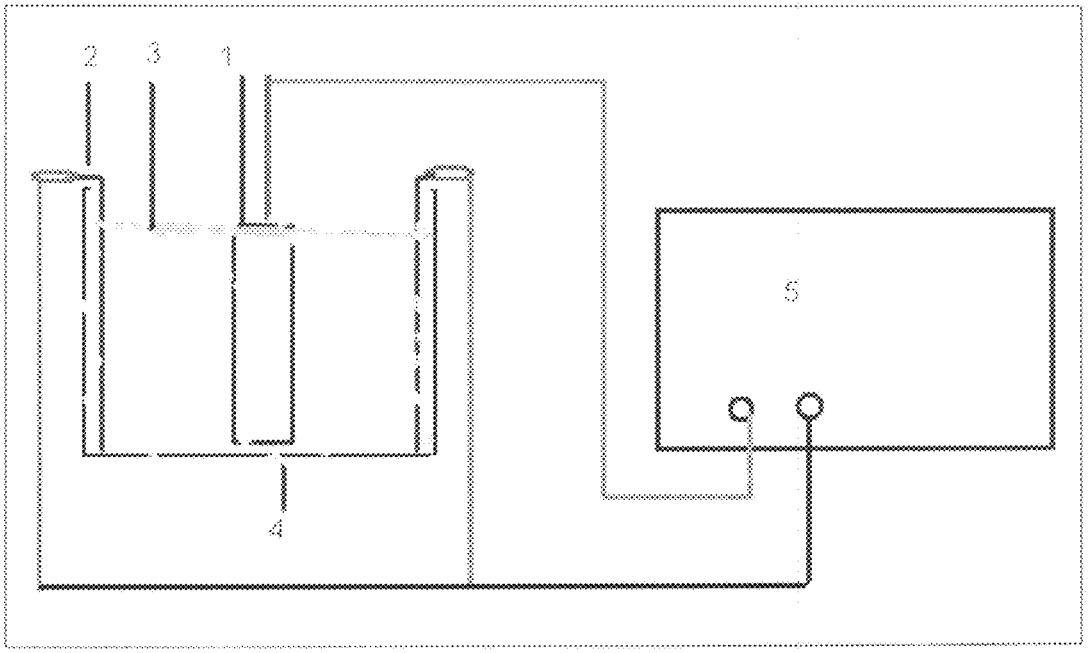
FIG. 1: Schematic view showing the apparatus used in electroplating technique.

In FIG. 1, part 1 shows the reticulated conducting foam as cathode, part 2 shows pure lead of dimension of 10×10×0.5 cm and purity of 99.9% used as anodes, part 3 plating solution used for coating the polymer foam, part 4 is plating bath—container used to keep the anode, cathode and solution and part 5 is a DC current source of range 0-30 Amps and 0-12 Volt used for electro plating. The operation of plating is carried out from 30° C. to 50° C. The plating has been carried out by plurally varying with respect to time and current to achieve different thickness of lead coating.

Figure 2:
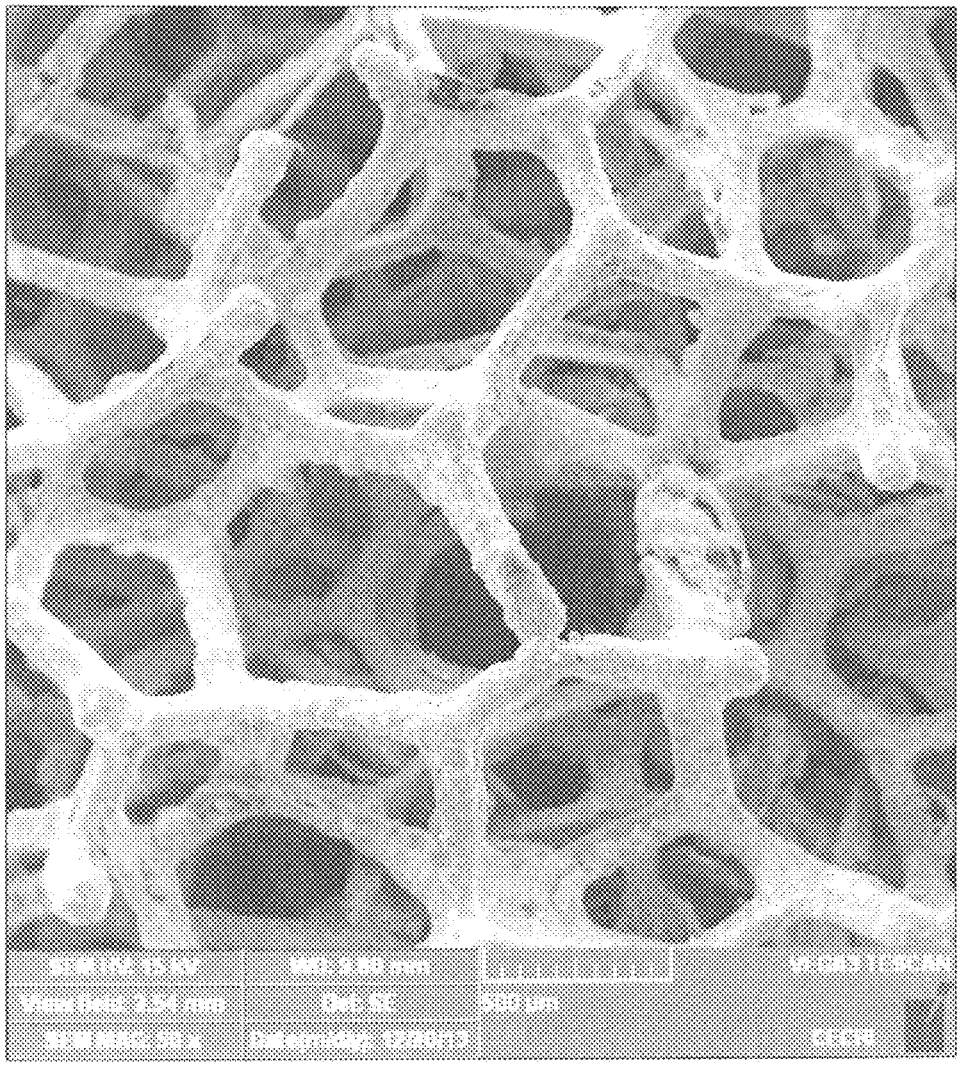
FIG. 2: SEM—micrograph of Lead Foam.

FIG. 2 shows the scanning electron micrograph of pure lead foam having lead filament thickness of the order of 45 to 60 micro meters and the pore size vary from 200 to 400 micro meters. The SEM is viewed with 50× magnification, 15 KV WD: 9.80 mm using vegan Tescan and the viewed field is 2.54 mm. The surface morphology of the lead foam in FIG. 2 shows a continuous smooth uniform deposit without any visible holes. The electrodeposited lead foam possesses rigidity with brightness.

Figure 3:
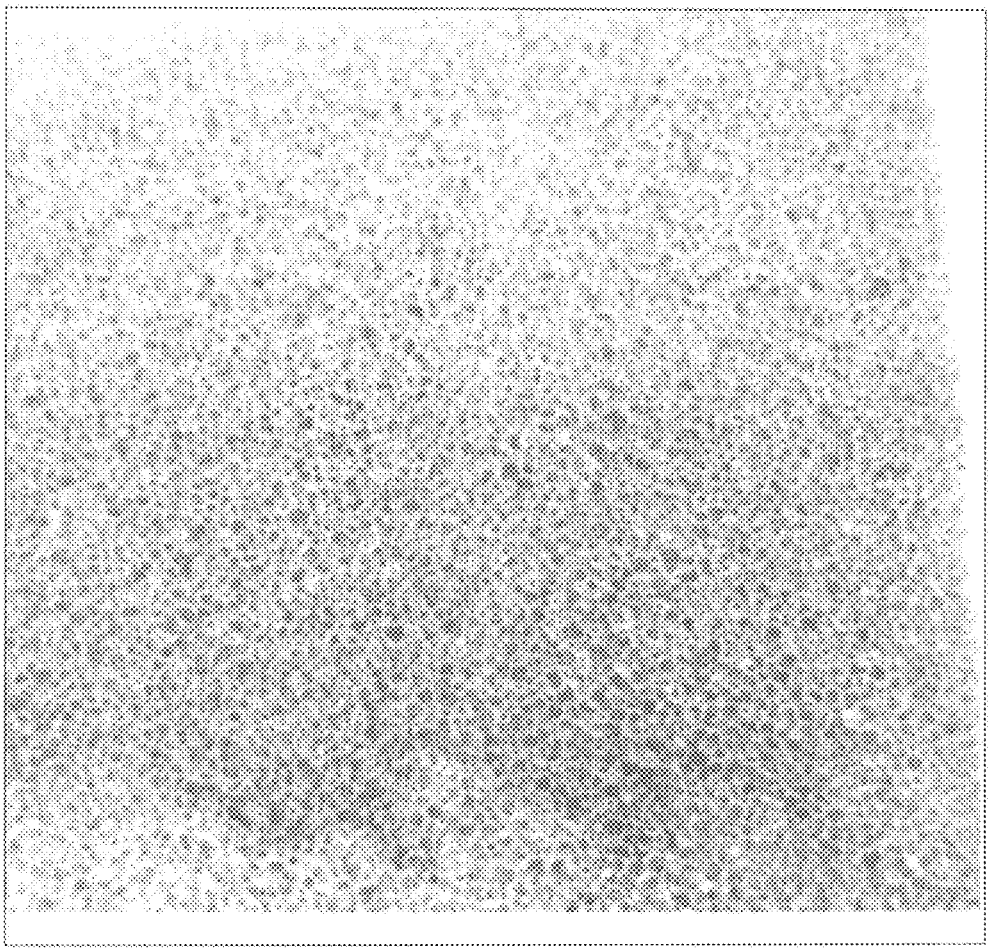
FIG. 3: Photograph of lead foam as prepared—porosity of 87%

FIG. 3 shows the photograph of electrochemically developed lead foam of 12×12 cm size without zoom. The porosity observed using xPRO, is of the order of 87% volume percentage. FIG. 3 shows the photograph of the lead foam that illustrates about 86% porosity. To test the purity of the lead foam, it is characterized for X-ray diffraction studies.

Figure 4:
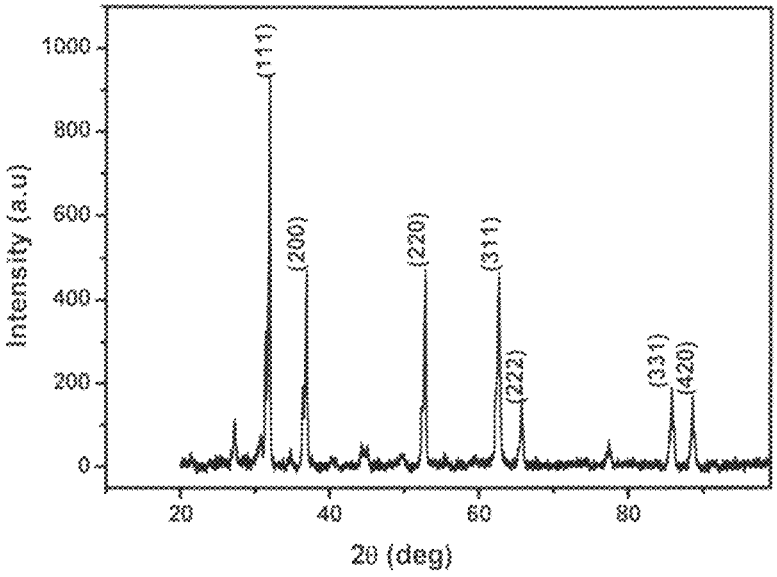
FIG. 4: XRD pattern of Lead foam.

FIG. 4 shows the XRD pattern, which depicts that it has only peaks related to lead metal. (Red-standard peaks and Blue obtained peaks). It shows that the foam material developed doesn't contain any impurity. As shown in FIG. 4, the XRD pattern depicts that it has only peaks related to lead. It shows that the foam material developed doesn't contain any other metallic impurity.

Accordingly, the present invention provides an electrochemical process for preparation of lead foam, which comprises a non-conducting reticulated structure polymer foam surface, activated using palladium chloride after cleaning with methanol or acetone, copper of thin layer coated by electro-less process and lead deposition by electroplating method, with base structure and copper were removed using organic solvents and acid treatment.

In an embodiment of the present invention involves making an electrochemical process for the preparation of lead foam. In this regard, the base substrate may be polymer foam. The embodiment describes the base medium of selection will be in such a way to achieve required porosity, thickness and required characteristic reticulated filament network structure for preparing lead foam. The embodiment describes the pre treatment of polymer foam for making non-conducting to conducting foam using suitably formulated chemical compounds such as stannous chloride, lead chloride, nickel chloride, platinum chloride, palladium chloride, auric chloride, silver chloride.

Yet another embodiment of the present invention is that pre-treated foam base will be made to flow current all over the reticulated network surface by providing a very fine conducting layer by using suitably formulated copper solutions containing chloride, sulphate, nitrate, acetate salts along with compound such as gelatin, ortho phosphoric acid, imidazole, peptone etc. The interlink metal made to have contact with the base by adjusting the electrochemical parameters such as pH, temperature, additives and bath composition of the system.

Yet another embodiment of the present invention is that the prepared conducting polymer foam will be coated with pure lead using a bath suitably formulated solution containing fluoborate, chloride, sulphate, nitrate, flouboric acid salts along with brighteners and additives such as boric acid, aromatic aldehydes and ketones, aliphatic hydroxy acid, aromatic nitrogen containing compounds, etc.

Good quality lead foam with high specific area, stability, porosity, resistivity, specific capacity and a uniform three-dimensional reticulate structure will be obtained by adjusting the operating current density ranged from 0.5 A/dm$^2$ to 5 A/dm$^2$, bath pH from 0.5 to 1.0, operating temperature range from 30° C. to 50° C., in presence of additives and brighteners followed with suitable post plating treatments. The polymer used will be dissolved using organic solvents and the unwanted metals other than lead will be dissolved in nitric acid, hydrochloric acid, sulphuric acid, etc.

As a final treatment the lead coated foam will be subjected to heat treatment in hydrogen atmosphere at the temperature of 180° C. to eradicate the strain and remove oxides from the system.

The following examples are given by way of illustration of the working of the invention in actual practice and therefore should not be construed to limit the scope of the present invention.

Example: 1

A non-conducting polyurethane foam of porosity of 86.5%, the filament thickness of 40 micron and the dimension of 10×10×0.2 cm was taken. In the first stage of process, a thin conductive layer over the surface of the polyeurethene foam was given by dipping (electroless plating) in the palladium chloride solution having a concentration 1:100 ratio (1 g palladium dissolved in 100 g of distilled water) followed by copper coating by electroless process using 30 g/l copper sulphate, 10 g/l paraformaldehyde, 15 g/l EDTA and 0.5 g/l gelatin at room temperature for 5 mins. In the second stage for deposition of lead over copper coated polyurethane foam, an electroplating set up shown in FIG. 1 is used. The lead plating bath contains 100 g/l fluoboric acid, 150 g/l Lead as fluoborate solutions, 20 g/l boric acid and 2 g/l Urea is employed. The operating current density is 0.5 A/dm$^2$, bath pH of 0.5, and operating temperature is 30° C., for a duration of 2 h. The thickness of lead coating obtained is 45 μm. In the third stage of process, after lead plating, the polyurethane foam and copper are removed by dipping in organic solvent having a combination of acetone, N-methyl pyrrolidone and dimethyl formamide in the ratio of 1:5:3, for 5 minutes followed by sulphuric acid treatment for 3 minutes to remove copper to obtain pure lead foam. In the fourth stage, the oxygen present in the lead foam is removed by heat treating the sample at 180° C. for 2 hrs in the reduced (hydrogen:argon=10:90 gas mixture) atmosphere.

Example: 2

A non-conducting polyurethane foam of porosity of 86.5%, the filament thickness of 40 micron and the dimension of 10×10λ0.2 cm was taken. In the first stage of process a thin conductive layer over the surface of polyeurethene foam was given by dipping (electroless plating) in the palladium chloride solution having a concentration 1:100 ratio (1 g palladium dissolved in 100 g of distilled water) followed by copper coating by electroless process using 30 g/l copper sulphate, 10 g/l paraformaldehyde, 15 g/l EDTA and 0.5 g/l gelatin at room temperature for 5 mins. In the second stage for deposition of lead over copper coated polyeurethene foam an electroplating set up shown in FIG. 1 is used. The lead plating bath contains 100 g/l fluoboric acid, 150 g/l Lead as fluoborate solutions, 20 g/l boric acid and 2 g/l Urea is employed. The operating current density is 2.5 A/dm$^2$, bath Ph 1.0 and operating temperature is 40° C., for a duration of 4 h. The thickness of lead coating obtained is 105 μm. In the third stage of the process, after lead plating, the polyeurethene foam and copper are removed by dipping in organic solvents having a combination of acetone, N-methyl pyrrolidone and dimethyl formamide in the ratio of 1:5:3 for 5 minutes, followed by sulphuric acid treatment for 3 minutes to remove copper to obtain pure lead foam. In the fourth stage, the oxygen present in the lead foam is removed by heat treating the sample at 190° C. for 2 hrs in the reduced (hydrogen:argon=10:90 gas mixture) atmosphere.

Example: 3

A non-conducting polyurethane foam of porosity of 86.5%, the filament thickness of 40 micron and the dimension of 10×10λ0.2 cm was taken. In the first stage of the process a thin conductive layer over the surface of the sample was given by dipping (electroless plating) in the palladium chloride solution having a concentration 1:100 ratio (1 g palladium dissolved in 100 g of distilled water) followed by copper coating by electroless process using 30 g/l copper sulphate, 10 g/l paraformaldehyde, 15 g/l EDTA and 0.5 g/l gelatin at room temperature for 5 mins. In the second stage for deposition of lead over copper coated polyeurethene foam an electroplating set up shown in shown in FIG. 1 is used. The plating bath containing 200 g/l fluoboric acid, 250 g/l Lead as fluoborate solutions, 30 g/l boric acid and 4 g/l Urea is employed. The operating current density is 5 A/dm$^2$, bath pH of 2.0, and operating temperature is 50° C., for a duration of 6*h*. The thickness of lead coating obtained is 180 μm. In the third stage of process, after lead plating, the polyeurethene foam and copper are removed by dipping in organic solvents having a combination of acetone, N-methyl pyrrolidone and dimethyl formamide in the ratio of 1:5:3, for 5 minutes followed by sulphuric acid treatment for 3 minutes to remove copper to obtain pure lead foam. In the fourth stage the oxygen present in the lead foam is removed by heat treating the sample at 210° C. for 2 hrs in the reduced (hydrogen:argon=10:90 gas mixture) atmosphere.

Advantages of the Present Invention

1. The electrochemical plating technology is simple and cost effective
2. The Lead foam developed will be employed as grid in Lead-acid battery replacing the conventional grid.
3. Use of reticulated structure will prevent the shedding of active material during cycling in Lead-acid battery.
4. The highly distributed Lead reticulated connection will pay advantage in getting high rate capability in Lead-acid battery.
5. The Lead foam weight in comparison with standard grid is less, will target to get light weight Lead acid battery. In other word it may pave way for higher Energy density.
6. Lead foam may be used in radioactive shielding, liquid filtering, sound filters, and blockers as sound proof material, cushioning material in automobile due to its soft and spongy character.

We claim:

1. An electrochemical process for the preparation of lead foam comprising the steps:
- (i) providing a polymer foam and coating a thin conductive layer over the surface of polymer foam,
- (ii) coating copper over the conductive polymer foam as obtained in step (i) by electroless process to obtain copper coated polymer foam,
- (iii) depositing lead over the copper coated polymer foam as obtained in step (ii) by electroplating process to obtain lead plated copper coated polymer foam,
- (iv) removing the polymer foam and copper from the lead plated copper coated polymer foam as obtained in step (iii) by dipping it in organic solvent followed by sulphuric acid treatment to obtain lead foam.

2. The process of claim 1, further comprising treating the lead foam at 180 to 210° C. for 1 to 3 hrs in reduced atmosphere.

3. An electrochemical process for preparation of lead foam comprising the steps:
- (i) dipping a non-conducting polymer foam in palladium chloride solution having concentration 1:100 ratio by electroless process to obtain a thin conductive layer over the surface of polymer foam,
- (ii) coating copper over a thin conductive layer over the surface of polymer foam as obtained in step (i) by electroless process using copper sulphate, paraformaldehyde, EDTA and gelatin at room temperature for 2 to 5 min to obtain copper coated polymer foam,
- (iii) depositing lead over copper coated polymer foam as obtained in step (ii) by electroplating process wherein the lead plating bath contains 100-200 g/l fluoboric acid, 150-250 g/l Lead as fluoborate solutions, 20-30 g/l boric acid and 2-4 g/l urea at a current density in the range 0.5 to 5.0 A/dm$^2$, bath pH ranging from 0.5 to 2 at temperature ranging from 30 to 50° C. for 2 to 6 hrs to obtain lead plated copper coated polymer foam,
- (iv) removing polymer foam and copper from lead plated copper coated polymer foam as obtained in step (iii) by dipping it in organic solvent for time ranging from 2 to 5 min followed by sulphuric acid treatment for 1 to 5 min to obtain lead foam,
- (v) removing oxygen present in the lead foam by heat treating the product as obtained in step (iv) at 180 to 210° C. for 1 to 3 hrs in reduced atmosphere.

4. An electrochemical process for the preparation of lead foam as claimed in claim 3, wherein the polymer foam used is polyurethane foam of porosity in the range of 80% to 90%.

5. An electrochemical process for the preparation of lead foam as claimed in claim 3, wherein the copper coating by electroless process is done by using concentration of 30 g/L copper sulphate, 10 g/L paraformaldehyde, 15 g/L EDTA and 0.5 g/L gelatin.

6. An electrochemical process for the preparation of lead foam as claimed in claim 3, wherein the thickness of the lead coating obtained is 45-180 μm.

7. An electrochemical process for the preparation of lead foam as claimed in claim 3, wherein the organic solvents used are preferably selected from acetone, N-methyl pyrrolidone and dimethyl formamide in the ratio 1:5:3 respectively.

8. An electrochemical process for the preparation of lead foam as claimed in claim 3, wherein the reduced atmosphere generated is preferably selected from hydrogen:argon in the ratio 10:90 gas mixture.

* * * * *